US006811373B2

(12) United States Patent
Tomita et al.

(10) Patent No.: US 6,811,373 B2
(45) Date of Patent: Nov. 2, 2004

(54) TURBINE MOVING BLADE, TURBINE STATIONARY BLADE, TURBINE SPLIT RING, AND GAS TURBINE

(75) Inventors: Yasuoki Tomita, Takasago (JP); Shigehiro Shiozaki, Takasago (JP); Kengo Yamaguchi, Takasago (JP); Hideaki Kaneko, Takasago (JP); Kotaro Ohshima, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 288 days.

(21) Appl. No.: 10/067,947

(22) Filed: Feb. 8, 2002

(65) Prior Publication Data

US 2002/0127111 A1 Sep. 12, 2002

(30) Foreign Application Priority Data

Mar. 6, 2001 (JP) ..... 2001-062442

(51) Int. Cl.[7] ..... F01D 5/18

(52) U.S. Cl. ..... 415/173.1; 415/191; 415/208.1; 415/211.2; 416/189; 416/193 A

(58) Field of Search ..... 415/173.1, 191, 415/208.1, 211.2; 416/189, 191, 193 A

(56) References Cited

U.S. PATENT DOCUMENTS

| | | | | |
|---|---|---|---|---|
| 4,279,575 A | | 7/1981 | Avery | |
| 4,529,355 A | | 7/1985 | Wilkinson | |
| 4,914,794 A | | 4/1990 | Strangman | |
| 5,423,659 A | * | 6/1995 | Thompson | 415/173.1 |
| 5,439,348 A | * | 8/1995 | Hughes et al. | 415/173.4 |
| 5,843,586 A | * | 12/1998 | Schaeffer et al. | 428/633 |
| 6,126,400 A | * | 10/2000 | Nichols et al. | 416/241 B |
| 6,152,694 A | * | 11/2000 | Ai | 416/92 |
| 6,670,046 B1 | * | 12/2003 | Xia | 428/469 |

FOREIGN PATENT DOCUMENTS

| | | |
|---|---|---|
| EP | 0 949 404 | 10/1999 |
| EP | 1 146 201 | 10/2001 |
| FR | 1 005 997 | 4/1952 |
| GB | 535566 | 4/1941 |
| JP | 11-152584 | 6/1999 |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

The present invention provides a turbine moving blade, a turbine stationary blade, and a turbine split ring which are capable of restraining the deterioration and peeling-off of a thermal barrier coating easily and surely, and a gas turbine capable of enhancing the energy efficiency by increasing the temperature of combustion gas. The turbine moving blade provided in a turbine constituting the gas turbine includes a platform having a gas path surface extending in the combustion gas flow direction, and a blade portion erecting on the platform. The thermal barrier coating covering the gas path surface is formed so as to go around from the gas path surface to an upstream-side end face and a downstream-side end face of the outer peripheral faces of the platform.

12 Claims, 7 Drawing Sheets

TURBINE MOVING BLADE, TURBINE STATIONARY BLADE, TURBINE SPLIT RING, AND GAS TURBINE

BACKGROUND OF THE INVENTION AND RELATED ART STATEMENT

1. Field of the Invention

The present invention relates to a turbine moving blade, a turbine stationary blade, a turbine split ring, and a gas turbine provided with these elements.

2. Description of Related Art

Conventionally, gas turbines have been used widely in various fields as power sources. The conventionally used gas turbine is provided with a compressor, a combustor, and a turbine, and is constructed so that after air is compressed by the compressor and then is burned by the combustor, a high-temperature and high-pressure combustion gas is expanded by the turbine to obtain power. For the gas turbine of this kind, a larger increase in combustion gas temperature (turbine inlet temperature) has been intended to enhance the energy efficiency. In recent years, a gas turbine having a combustion gas temperature as high as about 1300° C. has been developed, and further a gas turbine having a combustion gas temperature of about 1500° C. has been proposed.

As described above, since the combustion gas having a temperature as high as 1000° C. or higher is introduced into the turbine for the gas turbine, various members such as a turbine moving blade, a turbine stationary blade, and a split ring, which are provided in the turbine, are made of a heat resisting alloy such as inconel. On the surfaces of these various members, a thermal barrier coating is provided to increase the heat resistance. The basic construction of these various members will now be described by taking the turbine moving blade as an example.

FIG. 10 is a sectional view showing an example of a conventional turbine moving blade. A turbine moving blade 101 shown in FIG. 10 has a platform 102 and a blade portion 103 erecting on the platform 102. With respect to the turbine moving blade 101, combustion gas is caused to flow in the direction of the arrows in the figure. The surface of the blade portion 103 and a gas path surface 104 extending in the gas flow direction of the platform 102 are covered with a thermal barrier coating 105. The thermal barrier coating 105 is composed of a topcoat 106 and an undercoat 107. The thermal barrier coating 105 constructed as described above serves to restrain heat conduction into the platform 102 and the blade portion 103.

However, the conventional turbine moving blade constructed as described above has a problem in that the thermal barrier coating 105 deteriorates and peels off in the vicinity of peripheral edge portion of the platform 102. The high-temperature and high-pressure combustion gas collides at a high speed with, for example, an upstream-side end face 108 perpendicular to the combustion gas flow direction indicated by the arrows, of the outer peripheral faces of the platform 102. Therefore, the thermal barrier coating 105 deteriorates and peels off first in the vicinity of the upstream-side end face 108. Likewise, the combustion gas collides at a certain degree of high speed with a downstream-side end face 110 perpendicular to the combustion gas flow direction (indicated by the arrows in the figure) of the platform 102, the collision being caused by vortexes etc. produced in the turbine. Therefore, the thermal barrier coating 105 deteriorates in the vicinity of the downstream-side end face 110, and in some cases, there is a fear of the thermal barrier coating 105 being peeled off. Moreover, the problem of deterioration and peeling of thermal barrier coating is also seen with a shroud of turbine moving blade, a shroud of turbine stationary blade, a turbine split ring, and the like.

OBJECT AND SUMMARY OF THE INVENTION

The present invention has been made in view of the above situation, and accordingly an object thereof is to provide a turbine moving blade, a turbine stationary blade, and a turbine split ring which are capable of restraining the deterioration and peeling-off of a thermal barrier coating easily and surely, and a gas turbine capable of enhancing the energy efficiency by increasing the temperature of combustion gas.

As defined in claim 1, the present invention provides a turbine moving blade comprising a platform having a gas path surface extending in the combustion gas flow direction, and a blade portion erecting on the platform, the gas path surface of platform being coated with a thermal barrier coating, wherein the thermal barrier coating is formed so as to go around from the gas path surface of platform to at least a part of the outer peripheral face of the platform.

In this turbine moving blade, in order to increase the heat resistance, the gas path surface of platform is coated with the thermal barrier coating composed of an undercoat and a topcoat. Conventionally, the turbine moving blade of this type has a problem in that the thermal barrier coating deteriorates and peels off in the peripheral edge portion of the platform, especially, in the vicinity of the upstream-side end face and the downstream-side end face which are perpendicular to the combustion gas flow direction. For this reason, the inventors carried on studies earnestly to restrain the deterioration and peeling-off of the thermal barrier coating, and resultantly found the fact described below.

In the conventional turbine moving blade, the end face of the thermal barrier coating is flush with the outer peripheral face (for example, the upstream-side end face and the downstream-side end face) of the platform. Therefore, in the vicinity of the peripheral edge portion of the platform, the undercoat of thermal barrier coating is not covered at all and is exposed. For this reason, for example, in the upstream-side end portion of the platform, the high-temperature combustion gas directly collides head-on with the undercoat, which has a lower heat resistance than the topcoat, at a high speed, so that the deterioration and peeling-off of the whole of the thermal barrier coating are accelerated. Also, in the downstream-side end portion of the platform as well, the combustion gas caused by vortexes etc. produced in the turbine collides at a certain degree of high speed, so that the deterioration and peeling-off of the whole of the thermal barrier coating are accelerated.

In view of such a fact, in the turbine moving blade in accordance with the present invention, the thermal barrier coating is formed so as to go around from the gas path surface of the platform to at least a part (at least any of the upstream-side end face, the downstream-side end face, and a side end face) of the outer peripheral face of the platform. Thereby, in a region in which the thermal barrier coating is caused to go around to the outer peripheral face, the outside surface of the thermal barrier coating, that is, the surface of the topcoat is made substantially parallel with the outer peripheral face of the platform. Therefore, the combustion gas can be prevented from directly colliding on-head with the undercoat of the thermal barrier coating at a high speed. Since the thermal barrier coating is caused to go around to at least a part of the outer peripheral face of the platform in this manner to make it difficult for the combustion gas to collide directly with the end face of the thermal barrier coating (end face of undercoat), the deterioration and peeling-off of the thermal barrier coating in the vicinity of the peripheral edge portion of the platform can be restrained easily and surely.

In this case, it is preferable that a step portion be formed in at least a part of the peripheral edge portion of the platform, and the thermal barrier coating be formed so that it goes around to the step portion and the end face thereof is in contact with the upper face of the step portion.

By causing the thermal barrier coating to go around to the step portion formed in the peripheral edge portion of the platform and by bringing the end face of the thermal barrier coating into contact with the upper face of the step portion, the undercoat of the thermal barrier coating is not exposed to the outside in the vicinity of the step portion. Therefore, in the above-described construction, the undercoat of the thermal barrier coating can be completely prevented from being exposed to combustion gas in the vicinity of the step portion. As a result, the deterioration and peeling-off of the thermal barrier coating in the vicinity of the peripheral edge portion of the platform can be restrained very surely.

As defined in claim 3, the present invention provides a turbine moving blade comprising a platform, a blade portion erecting on the platform, and a shroud provided at the tip end of the blade portion, a gas path surface extending in the combustion gas flow direction of the shroud being coated with a thermal barrier coating, wherein the thermal barrier coating is formed so as to go around from the gas path surface of shroud to at least a part of the outer peripheral face of the shroud.

In this turbine moving blade, the deterioration and peeling-off of the thermal barrier coating in the vicinity of the peripheral edge portion of the shroud provided at the tip end of the blade portion can be restrained easily and surely.

In this case, it is preferable that a step portion is formed in at least a part of the peripheral edge portion of the shroud, and the thermal barrier coating be formed so that it goes around to the step portion and the end face thereof is in contact with the upper face of the step portion.

As defined in claim 5, the present invention provides a turbine stationary blade comprising a pair of shrouds each having a gas path surface extending in the combustion gas flow direction, and a blade portion held between the shrouds, at least either one of the shrouds being coated with a thermal barrier coating, wherein the thermal barrier coating is formed so as to go around from the gas path surface of shroud to at least a part of the outer peripheral face of the shroud.

In this turbine stationary blade, the deterioration and peeling-off of the thermal barrier coating in the vicinity of the peripheral edge portion of at least either one of the shrouds provided at both ends of the blade portion can be restrained easily and surely.

In this case, it is preferable that a step portion be formed in at least a part of the peripheral edge portion of the shroud, and the thermal barrier coating be formed so that it goes around to the step portion and the end face thereof is in contact with the upper face of the step portion.

As defined in claim 7, the present invention provides a turbine split ring having a gas path surface extending in the combustion gas flow direction, the gas path surface being coated with a thermal barrier coating, wherein the thermal barrier coating is formed so as to go around from the gas path surface to at least a part of the outer peripheral face.

In this turbine split ring, the deterioration and peeling-off of the thermal barrier coating in the vicinity of the peripheral edge portion can be restrained easily and surely.

In this case, it is preferable that a step portion be formed in at least a part of the peripheral edge portion, and the thermal barrier coating be formed so that it goes around to the step portion and the end face thereof is in contact with the upper face of the step portion.

As defined in claim 9, the present invention provides a gas turbine for producing power by expanding a high-temperature and high-pressure combustion gas by using a turbine stationary blade and a turbine moving blade, wherein the turbine moving blade comprises a platform having a gas path surface extending in the combustion gas flow direction, a blade portion erecting on the platform, and a thermal barrier coating for covering the gas path surface of platform, and the thermal barrier coating is formed so as to go around from the gas path surface to at least a part of the outer peripheral face of the platform.

In this gas turbine, the deterioration and peeling-off of the thermal barrier coating in the vicinity of the peripheral edge portion of the platform of the turbine moving blade can be restrained easily and surely. Therefore, the temperature of combustion gas can be increased, so that the energy efficiency can be enhanced easily.

As defined in claim 10, the present invention provides a gas turbine for producing power by expanding a high-temperature and high-pressure combustion gas-by using a turbine stationary blade and a turbine moving blade, wherein the turbine moving blade comprises a platform, a blade portion erecting on the platform, a shroud provided at the tip end of the blade portion, and a thermal barrier coating for covering a gas path surface extending in the combustion gas flow direction of the shroud, and the thermal barrier coating is formed so as to go around from the gas path surface of shroud to at least a part of the outer peripheral face of the shroud.

In this gas turbine, the deterioration and peeling-off of the thermal barrier coating in the vicinity of the peripheral edge portion of the shroud of the turbine moving blade can be restrained easily and surely. Therefore, the temperature of combustion gas can be increased, so that the energy efficiency can be enhanced easily.

As defined in claim 11, the present invention provides a gas turbine for producing power by expanding a high-temperature and high-pressure combustion gas by using a turbine stationary blade and a turbine moving blade, wherein the turbine stationary blade comprises a pair of shrouds each having a gas path surface extending in the combustion gas flow direction, a blade portion held between the shrouds, and a thermal barrier coating for covering the gas path surface of at least either one of the shrouds, and the thermal barrier coating is formed so as to go around from the gas path surface of shroud to at least a part of the outer peripheral face of the shroud.

In this gas turbine, the deterioration and peeling-off of the thermal barrier coating in the vicinity of the peripheral edge portion of the shroud of the turbine stationary blade can be restrained easily and surely. Therefore, the temperature of combustion gas can be increased, so that the energy efficiency can be enhanced easily.

As defined in claim 12, the present invention provides a gas turbine for producing power by expanding a high-temperature and high-pressure combustion gas by using a turbine stationary blade and a turbine moving blade, wherein the gas turbine comprises a split ring having a gas path surface extending in the combustion gas flow direction and a thermal barrier coating for covering the gas path surface, which is provided at the outer periphery of the turbine moving blade, and the thermal barrier coating is formed so as to go around from the gas path surface of split ring to at least a part of the outer peripheral face of the split ring.

In this gas turbine, the deterioration and peeling-off of the thermal barrier coating in the vicinity of the peripheral edge portion of the split ring can be restrained easily and surely. Therefore, the temperature of combustion gas can be increased, so that the energy efficiency can be enhanced easily.

As described above, in the gas turbine moving blade, the gas turbine stationary blade, and the gas turbine split ring in accordance with the present invention, the thermal barrier coating is formed so as to go around from the gas path surface of the platform, the shroud, and the split ring body to at least a part of the outer peripheral face. As a result, the deterioration and peeling-off of the thermal barrier coating in the peripheral edge portion of the platform, the shroud, and the split ring body can be restrained easily and surely.

Thereupon, if the above-described gas turbine moving blade, gas turbine stationary blade, or gas turbine split ring is used for a gas turbine, the temperature of combustion gas can be increased, so that the energy efficiency can be enhanced easily.

DETAILED DESCRIPTION OF PREFERRED EMBODIMENTS

Preferred embodiments of a turbine moving blade, turbine stationary blade, turbine split ring, and gas turbine in accordance with the present invention will now be described in detail with reference to the accompanying drawings.

Figure 1:
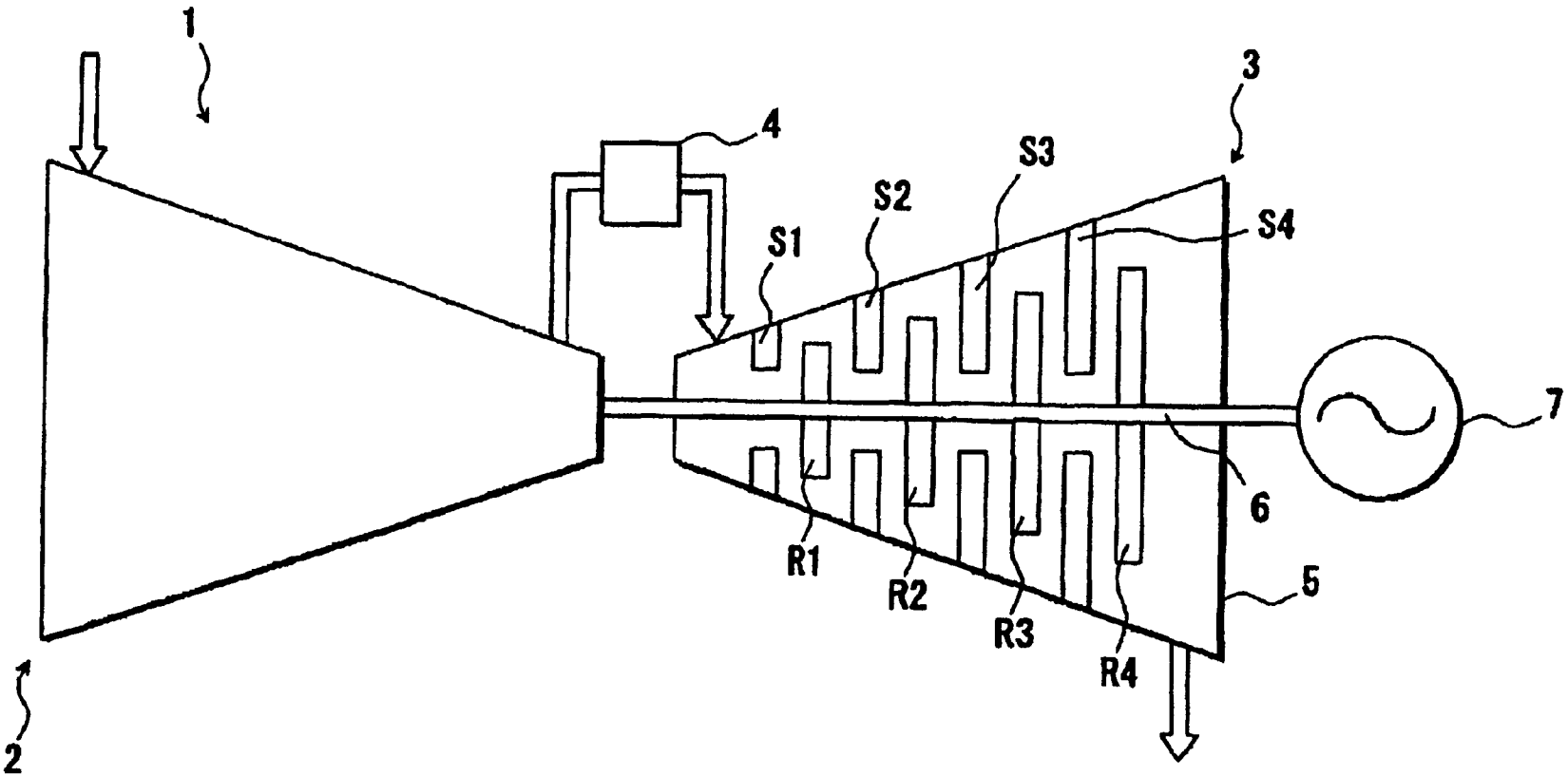
FIG. 1 is a schematic view of a gas turbine in accordance with an embodiment of the present invention.

FIG. 1 is a schematic view of the gas turbine in accordance with an embodiment of the present invention. A gas turbine 1 shown in FIG. 1 has a compressor 2 and a turbine 3, which are connected to each other. The compressor 2 consists of, for example, an axial flow compressor in which air or a predetermined gas is sucked through an intake port and is pressurized. To a discharge port of this compressor 2 is connected a combustor 4. A fluid discharged from the compressor 2 is heated to a predetermined turbine inlet temperature (for example, about 1300 to 1500° C.). The fluid heated to the predetermined temperature is supplied to the turbine 3 as a combustion gas.

Figure 2:
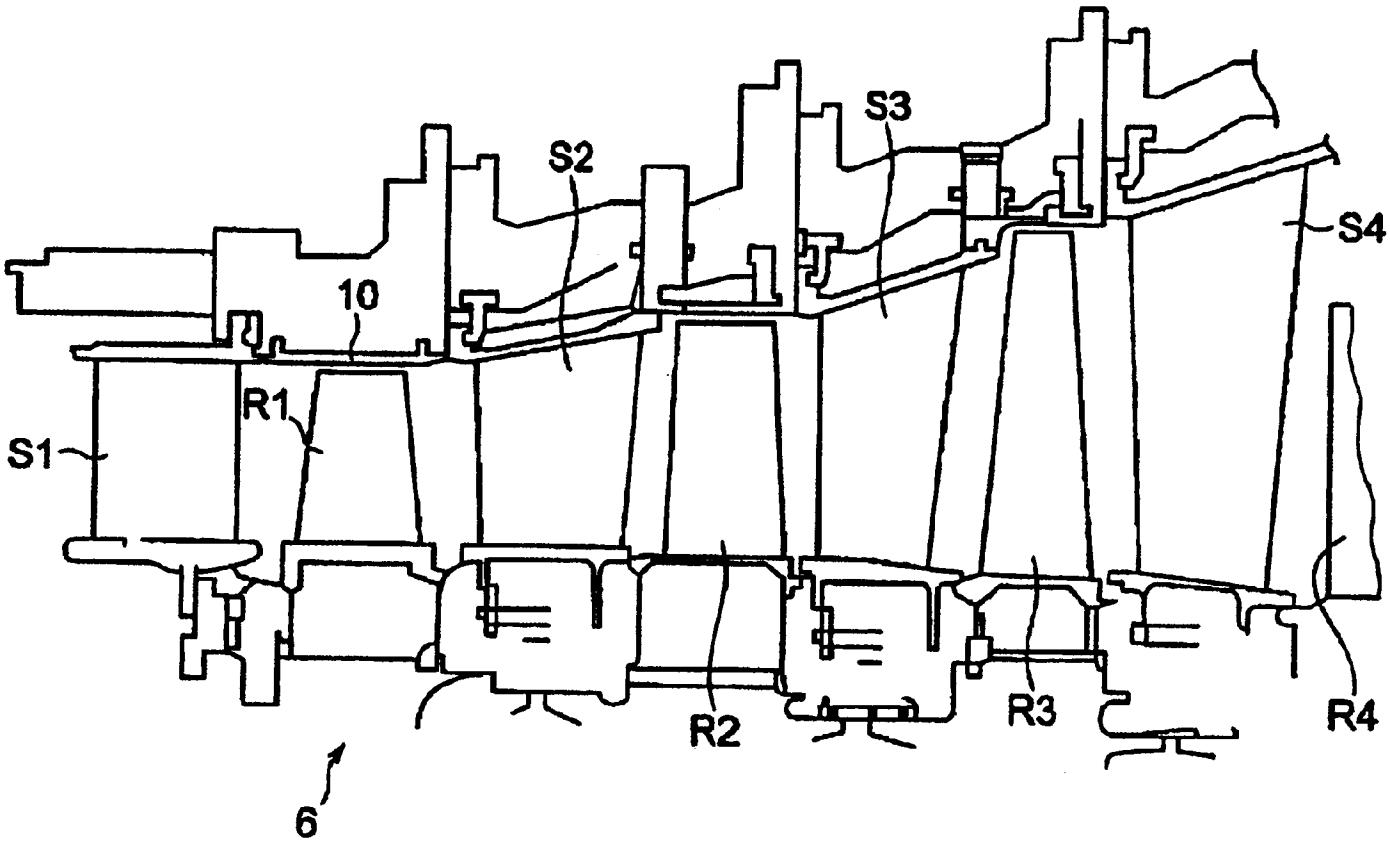
FIG. 2 is a sectional view of an essential portion of a turbine for a gas turbine in accordance with an embodiment of the present invention.

As shown in FIGS. 1 and 2, the turbine 3 has a plurality of turbine stationary blades S1, S2, S3 and S4 fixed in a casing 5. Also, on a rotor (main shaft) 6 of the turbine 3, there are installed turbine moving blades R1, R2, R3 and R4 each of which forms one set of stage together with each of the turbine stationary blades S1 to S4. Also, as shown in FIG. 2, a split ring 10 is installed via a blade ring within the casing 5 so as to surround the outer periphery of the turbine moving blade R1. One end of the rotor 6 is connected to the rotating shaft of the compressor 2, and the other end thereof is connected to the rotating shaft of a generator 7.

Therefore, when the high-temperature and high-pressure combustion gas is supplied from the combustor 4 into the casing 5 of the turbine 3, the combustion gas is expanded in the casing 5, by which the rotor 6 is rotated, and thus the generator 7 is driven. Specifically, the combustion gas supplied into the casing 5 is decreased in pressure by the turbine stationary blades S1 to S4 fixed to the casing 5, and kinetic energy developed thereby is converted into rotational torque via the turbine moving blades R1 to R4 installed on the rotor 6. The rotational torque produced by the turbine moving blades R1 to R4 is transmitted to the rotor 6 to drive the generator 7 via the rotating shaft thereof.

For the gas turbine 1 constructed as described above, an aim in increasing the combustion gas temperature (turbine inlet temperature) to a very high temperature, for example, about 1300 to 1500° C. is pursued in order to enhance the energy efficiency. For this purpose, measures as described below are taken regarding the turbine moving blades R1 to R4, turbine stationary blades S1 to S4, and split ring 10 provided in the turbine 3 for the gas turbine 1. Next, the turbine moving blade, turbine stationary blade, and turbine split ring in accordance with the present invention will be described.

Figure 3:
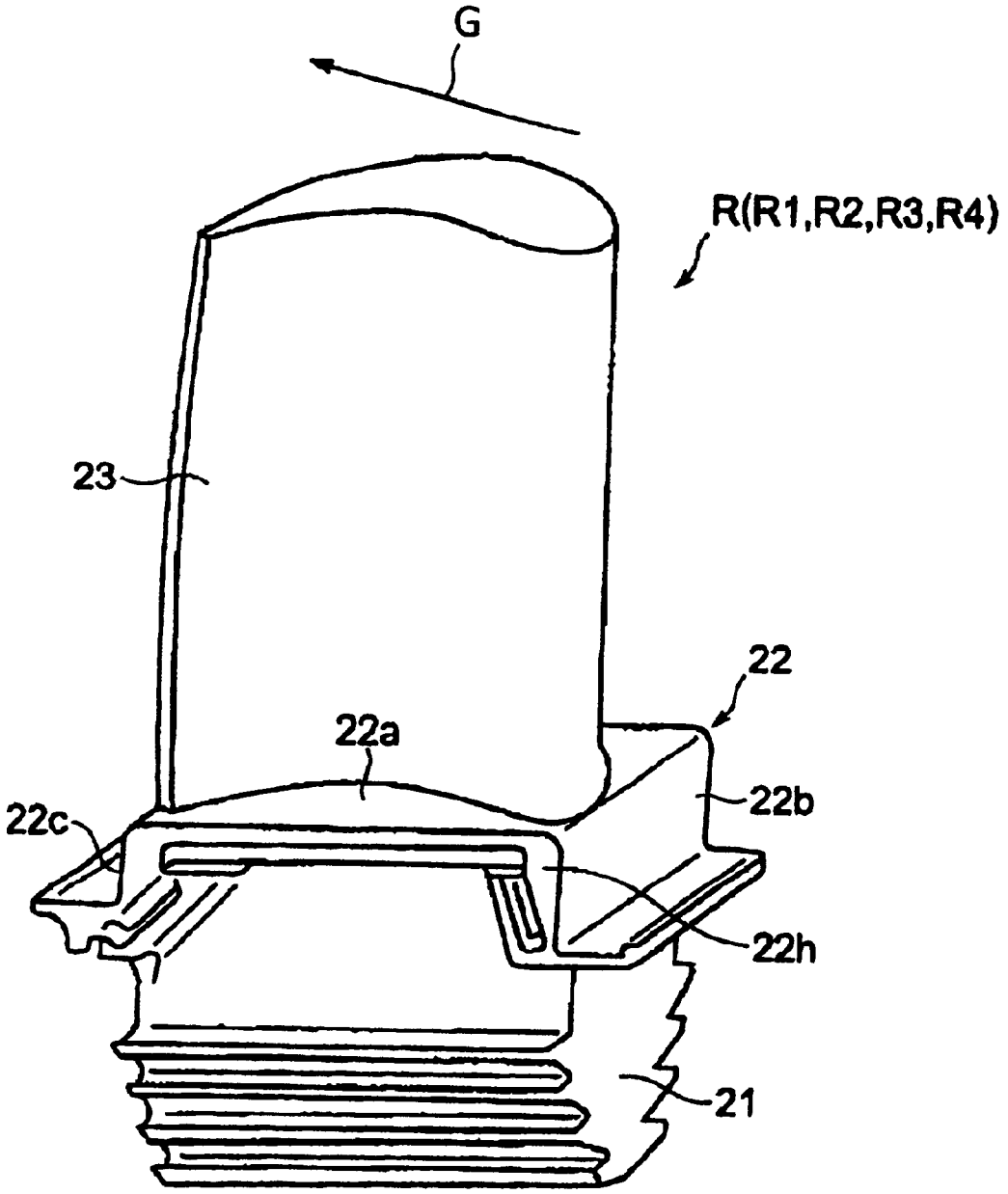
FIG. 3 is a perspective view of a gas turbine moving blade in accordance with an embodiment of the present invention.
Figure 4:
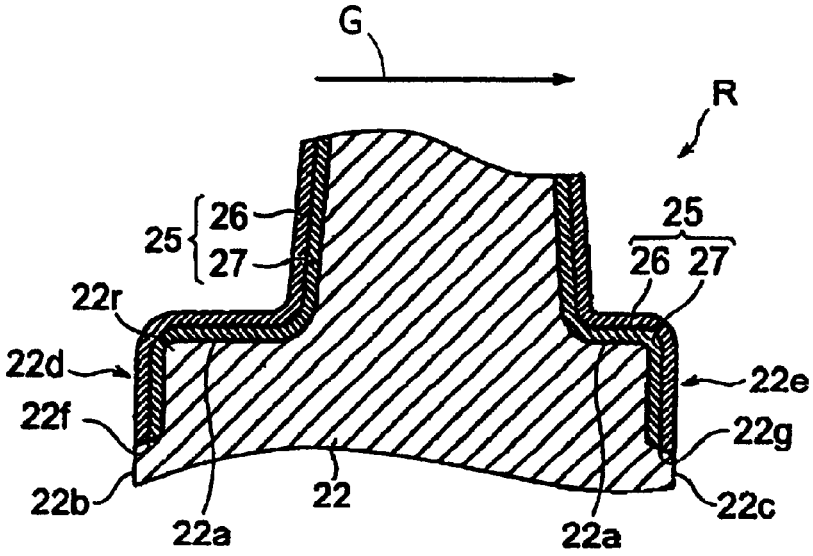
FIG. 4 is a longitudinal sectional view of a gas turbine moving blade in accordance with an embodiment of the present invention.

FIG. 3 is a perspective view showing the turbine moving blade provided in the turbine 3 for the above-described gas turbine 1. Since the turbine moving blades R1 to R4 basically have the same construction, they will now be explained as a turbine moving blade R. As shown in FIG. 3, the turbine moving blade R includes a base 21 fitted in the rotor 6, a platform 22 provided above the base 21, and a blade portion 23 erecting on the platform 22. All of the base 21, the platform 22, and the blade portion 23 are made of a heat resisting alloy such as inconel. For this turbine moving blade R, in order to further increase the heat resistance, as shown in FIG. 4, the surface of the blade portion 23 and a gas path surface 22*a* extending in the combustion gas flow direction (in the direction indicated by the arrow G) of the platform 2 are coated with a thermal barrier coating 25 composed of a topcoat 26 and an undercoat 27.

As the topcoat 26, a material, for example, YSZ (Yttria Stabilized Zirconia) which has high heat resistance and low heat conductivity is used. As the undercoat 27, a material, for example, NiCoCrAlY (especially, NiCoCrAlYTaReHfSi) which has high corrosion resistance and oxidation resistance is used. By providing the undercoat 27 in the thermal barrier coating 25 in this manner, the adhesion of the whole of the thermal barrier coating 25 and that between the blade portion 23 and the gas path surface 22*a* can be increased. Also, the undercoat 27 has a coefficient of thermal expansion that has a substantially middle value between the coefficient of thermal expansion of the topcoat 26 and that of a base material (the blade portion 23 and the gas path surface 22*a*). Therefore, the peeling of the thermal barrier coating 25 caused by heat history can be prevented.

Figure 10:
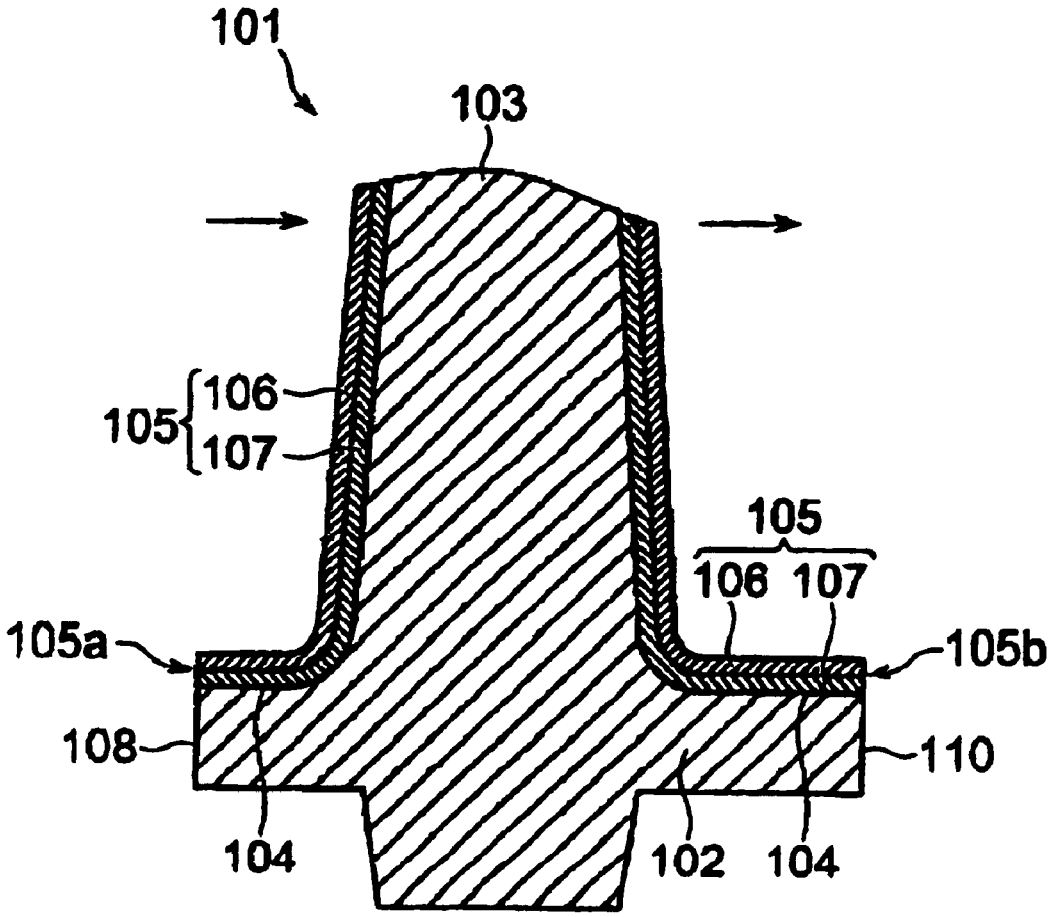
FIG.10 (RELATED ART)
FIG. 10 is a longitudinal sectional view of a conventional gas turbine moving blade.

The turbine moving blade of this type has presented a problem in that the thermal barrier coating deteriorates and peels off in the peripheral edge portion of the platform, especially in the vicinity of the upstream-side end face and the downstream-side end face which are perpendicular to the combustion gas flow direction G. Specifically, referring again to FIG. 10, in the conventional turbine moving blade 101, end faces 105*a* and 105*b* of the thermal barrier coating 105 are flush with the upstream-side end face 108 and the downstream-side end face 110 of the platform, respectively. Therefore, on the upstream-side end face 108 and the downstream-side end face 110 of the platform 102, the undercoat 107 of the thermal barrier coating 105 is not covered, being exposed.

For this reason, in the upstream-side end portion of the platform 102, the high-temperature combustion gas directly collides head-on with the undercoat 107, which has a lower heat resistance than the topcoat 106, at a high speed. Therefore, the deterioration and peeling-off of the whole of the thermal barrier coating 105 are accelerated. Likewise, in the downstream-side end portion of the platform 102 as well, the combustion gas caused by vortexes etc. produced in the turbine collides at a certain degree of high speed, so that the deterioration and peeling-off of the whole of the thermal barrier coating 105 are accelerated.

In view of such a fact, in the turbine moving blade R in accordance with the embodiment of the present invention, as shown in FIG. 4, the thermal barrier coating 25 is formed so as to go around from the gas path surface 22*a* of the platform 22 to an upstream-side end face 22*b* and a downstream-side end face 22*c* perpendicular to the combustion gas flow direction G, of the outer peripheral faces of the platform 22.

Specifically, of the upper-side peripheral edge portions of the platform 22, in a peripheral edge portion along the upstream-side end face 22*b*, a step portion 22*d* is formed, while in a peripheral edge portion along the downstream-side end face 22*c*, a step portion 22*e* is formed. The thermal barrier coating 25 is mounted to the platform 22 so as to go around to the step portions 22*d* and 22*e*. The upstream-side end face of the thermal barrier coating 25 (topcoat 26 and undercoat 27) is in contact with an upper face 22*f* of the step portion 22*d*, and the downstream-side end face thereof is in contact with an upper face 22*g* of the step portion 22*e*. Also, in the upstream-side end portion and the downstream-side end portion of the platform 22, the outside face in both end portions of the thermal barrier coating 25, that is, the surface of the topcoat 26 is flush with the upstream-side end face 22*b* or the downstream-side end face 22*c* of the platform. In order to enhance the adhesion of the thermal barrier coating 25 in the step portions 22*d* and 22*e*, it is preferable to form a chamfered portion 22*r* in the peripheral edge portion of the platform 22.

According to this embodiment, the thermal barrier coating 25 is caused to go around to the step portions 22*d* and 22*e* formed in the peripheral portion of the platform 22, and the end face of the thermal barrier coating 25 is brought into contact with the upper faces 22*f* and 22*g* of the step portions 22*d* and 22*e*. Therefore, in the up stream-side end portion and the downstream-side end portion of the platform 22, the undercoat 27 of the thermal barrier coating 25 is not exposed to the outside. Thereby, the undercoat 27 of the thermal barrier coating 25 can be completely prevented from being exposed to combustion gas in the vicinity of the step portions 22*d* and 22*e*. Accordingly, the deterioration and peeling-off of the thermal barrier coating 25 in the vicinity of the peripheral edge portion of the platform 22 can be restrained very surely.

In this case, the upper faces 22*f* and 22*g* of the step portions 22*d* and 22*e* are preferably somewhat inclined with respect to the combustion gas flow direction as shown in FIG. 4. Thereby, the influence of heat of combustion gas on the undercoat 27 can be reduced. Also, the step portions 22*d* and 22*e* need not necessarily be provided. In the state in which the step portions 22*d* and 22*e* are omitted, the thermal barrier coating 25 may be formed so as to go around from the gas path surface 22*a* to the upstream-side end face 22*b* and the downstream-side end face 22*c* of the platform.

In the construction as described above, in the upstream-side end portion and the downstream-side end portion of the platform 22, the end outside face of the thermal barrier coating 25, that is, the surface of the topcoat 26 is substantially parallel with the upstream-side end face 22*b* and the downstream-side end face 22*c* of the platform 22. Therefore, the combustion gas can be prevented from directly colliding head-on with the undercoat 27 of the thermal barrier coating 25 at a high speed.

Furthermore, although not shown in the figure, the thermal barrier coating 25 may be formed so as to go around from the gas path surface 22*a* of the platform 22 to a side end face 22*h* (see FIG. 3) of the platform. In this case, it is preferable that a step portion be formed in advance in a peripheral edge portion along the side end face 22*h*, of the upper-side peripheral edge portions of the platform, and the side end face of the thermal barrier coating 25 be brought into contact with the upper face of the step portion. Since the thermal barrier coating 25 is formed so as to go around to at least a part of the outer peripheral face of the platform in such a manner as to prevent the combustion gas from directly colliding with the end face of the thermal barrier coating 25 (end face of the undercoat 27), the deterioration and peeling-off of the thermal barrier coating 25 in the vicinity of the peripheral edge portion of the platform 22 can be restrained easily and surely.

Figure 5:
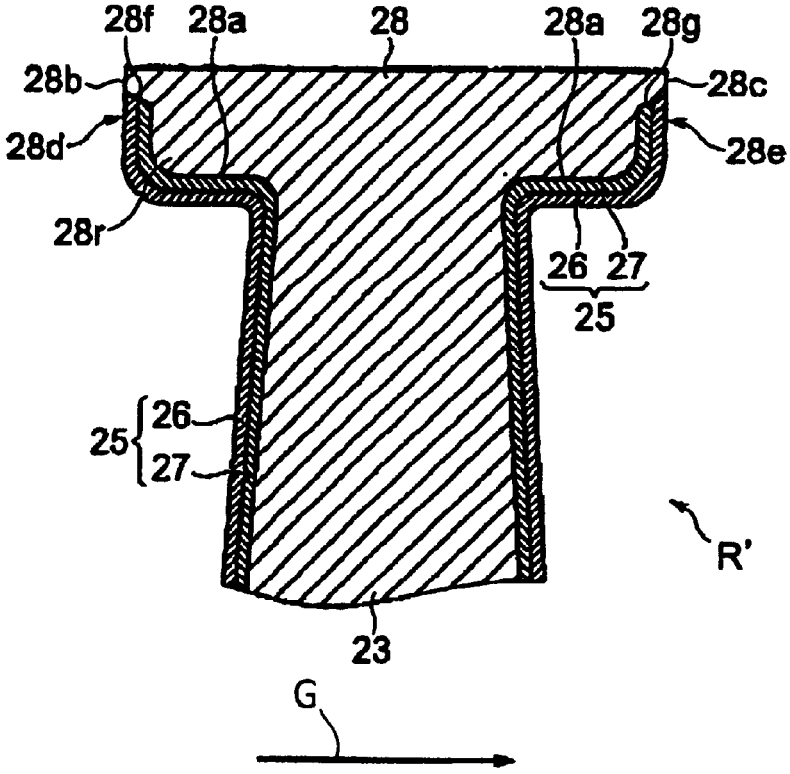
FIG. 5 is a longitudinal sectional view showing another mode of a gas turbine moving blade in accordance with an embodiment of the present invention.

FIG. 5 shows another mode of a gas turbine moving blade in accordance with the present invention. A turbine moving blade R' shown in FIG. is provided with a shroud 28, which is provided at the tip end of the blade portion 23 erecting on the platform, not shown in FIG. 5. In this case, a gas path surface 28*a* extending in the combustion gas flow direction G of the shroud 28 is coated with the thermal barrier coating 25 composed of the topcoat 26 and the undercoat 27. The thermal barrier coating 25 is formed so as to go around from the gas path surface 28*a* of the shroud 28 to an upstream-side end face 28*b* and a downstream-side end face 28*c* perpendicular to the combustion gas flow direction, of the outer peripheral faces of the shroud 28.

Specifically, of the upper-side peripheral edge portions of the shroud 28, in a peripheral edge portion along the upstream-side end face 28*b*, a step portion 28*d* is formed, while in a peripheral edge portion along the downstream-side end face 28*c*, a step portion 28*e* is formed. The thermal barrier coating 25 is mounted to the shroud 28 so as to go around to the step portions 28*d* and 28*e*. The upstream-side end face of the thermal barrier coating 25 (topcoat 26 and undercoat 27) is in contact with an upper face 28*f* of the step portion 28*d*, and the downstream-side end face thereof is in contact with an upper face 28*g* of the step portion 28*e*. Also, in the upstream-side end portion and the downstream-side end portion of the shroud 28, the outside face in both end portions of the thermal barrier coating 25, that is, the surface of the topcoat 26 is flush with the upstream-side end face 28*b* or the downstream-side end face 28*c* of the shroud 28.

In the turbine moving blade R' constructed as described above, the deterioration and peeling-off of the thermal barrier coating 25 in the vicinity of the upstream-side end portion and the downstream-side end portion of the shroud 28 provided at the tip end of the blade portion 23 can be restrained easily and surely. In this case as well, the thermal barrier coating 25 may be formed so as to go around from the gas path surface 28*a* of the shroud 28 to a side end face of the shroud 28. In this case, it is preferable that a step portion be formed in a peripheral edge portion along the side end face, of the upper-side peripheral edge portions of the shroud 28, and the side end face of the thermal barrier coating 25 be brought into contact with the upper face of the step portion.

Figure 6:
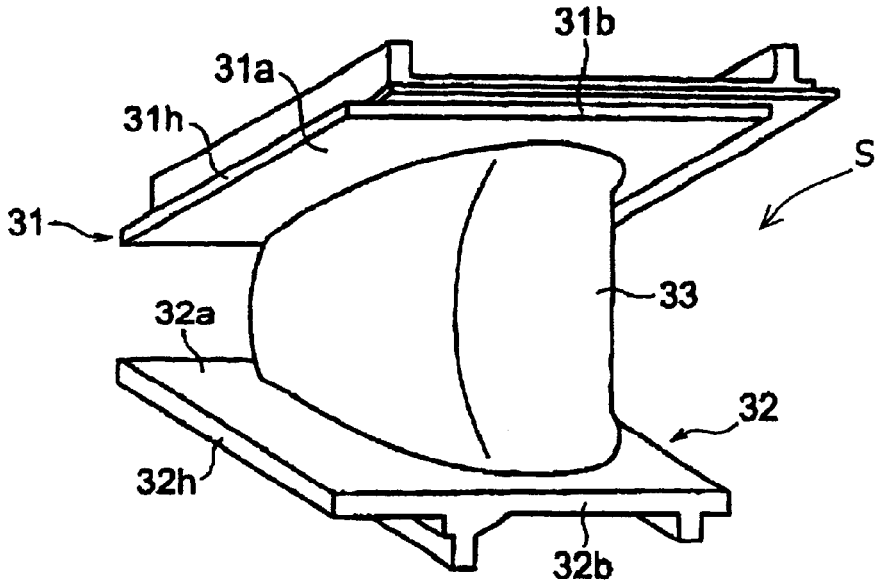
FIG. 6 is a perspective view of a gas turbine stationary blade in accordance with an embodiment of the present invention.
Figure 7:
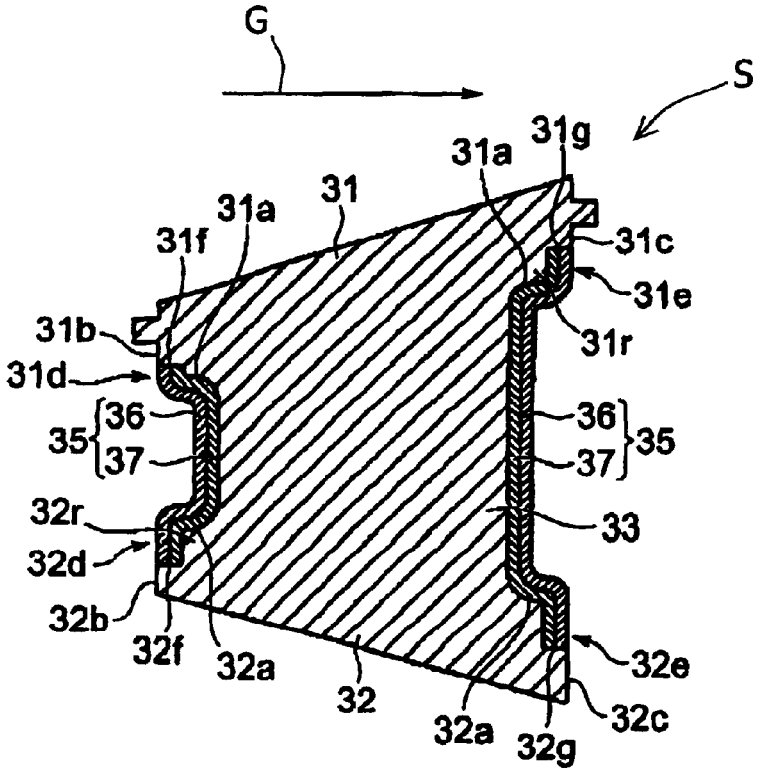
FIG. 7 is a longitudinal sectional view of a gas turbine stationary blade in accordance with an embodiment of the present invention.

FIG. 6 is a perspective view showing a turbine stationary blade provided in the turbine 3 for the above-described gas turbine 1. Since the turbine stationary blades S1 to S4 basically have the same construction, they will now be explained as a turbine stationary blade S. As shown in FIG. 6, the turbine stationary blade S has a pair of shrouds 31 and 32 each having the gas path surface extending in the combustion gas flow direction and a blade portion 33 held between the shroud 31 and the shroud 32. For the turbine stationary blade S, in order to further increase the heat resistance, as shown in FIG. 7, the surface of the blade portion 33 and gas path surfaces 31*a* and 32*a* extending in the combustion gas flow direction (in the direction indicated by the arrow G) of the shrouds 31 and 32 are coated with a thermal barrier coating 35 composed of a topcoat 36 and an undercoat 37.

The thermal barrier coating 35 is formed so as to go around from the gas path surfaces 31*a* and 32*a* of the shroud 31 and 32 to upstream-side end faces 31*b* and 32*b* and downstream-side end faces 31*c* and 32*c*, which are perpendicular to the combustion gas flow direction G, of the outer peripheral faces of the shrouds 31 and 32. Specifically, of the upper-side peripheral edge portions of the shroud 31, in a peripheral edge portion along the upstream-side end face 31*b*, a step portion 31*d* is formed, while in a peripheral edge portion extending along the downstream-side end face 31*c*, a step portion 31*e* is formed. Likewise, of the upper-side peripheral edge portions of the shroud 32, in a peripheral edge portion along the upstream-side end face 32*b*, a step portion 32*d* is formed, while in a peripheral edge portion along the downstream-side end face 32*c*, a step portion 32*e* is formed.

In the upper part of the turbine stationary blade S, the thermal barrier coating 35 is mounted on the shroud 31 so as to go around to the step portions 31*d* and 31*e*. The upstream-side end face of the thermal barrier coating 35 (topcoat 36 and undercoat 37) is in contact with an upper face 31*f* of the step portion 31*d*, and the downstream-side end face thereof is in contact with an upper face 31*g* of the step portion 31*e*. Also, in the upstream-side end portion and the downstream-side end portion of the shroud 31, the outside face in both end portions of the thermal barrier coating 35, that is, the surface of the topcoat 36 is flush with the upstream-side end face 31*b* or the downstream-side end face 31*c* of the shroud 31.

Likewise, in the lower part of the turbine stationary blade S, the thermal barrier coating 35 is mounted on the shroud 32 so as to go around to the step portions 32*d* and 32*e*. The upstream-side end face of the thermal barrier coating 35 (topcoat 36 and undercoat 37) is in contact with an upper face 32*f* of the step portion 32*d*, and the downstream-side end face thereof is in contact with an upper face 32*g* of the step portion 32*e*. Also, in the upstream-side end portion and the downstream-side end portion of the shroud 32, the outside face in both end portions of the thermal barrier coating 35, that is, the surface of the topcoat 36 is flush with the upstream-side end face 32*b* or the downstream-side end face 32*c* of the shroud 32.

In the turbine stationary blade S constructed as described above, the deterioration and peeling-off of the thermal barrier coating 35 in the vicinity of the upstream-side end portion and the downstream-side end portion of the shrouds 31 and 32 provided at the both ends of the blade portion 33 can be restrained easily and surely. In this case as well, the thermal barrier coating 35 may be formed so as to go around from the gas path surface 31*a*, 32*a* of the shroud 31, 32 to a side end face 31*h*, 32*h* (see FIG. 6) of the shroud 31, 32. In this case, it is preferable that a step portion be formed in a peripheral edge portion along the side end face 31*h*, 32*h*, of the upper-side peripheral edge portion of the shroud 31, 32, and the side end face of the thermal barrier coating 35 be brought into contact with the upper face of the step portion.

Figure 8:
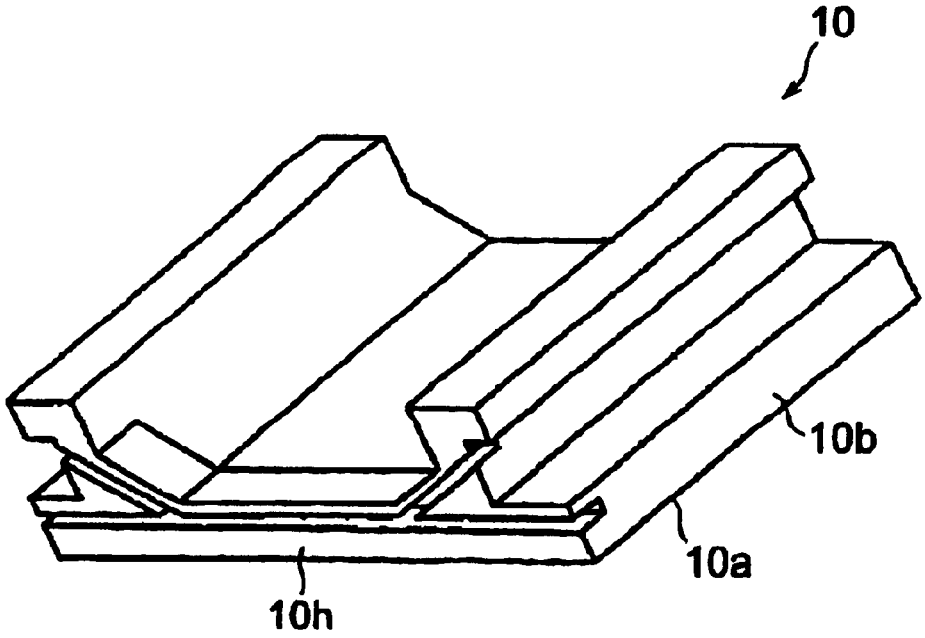
FIG. 8 is a perspective view of a gas turbine split ring in accordance with an embodiment of the present invention.
Figure 9:
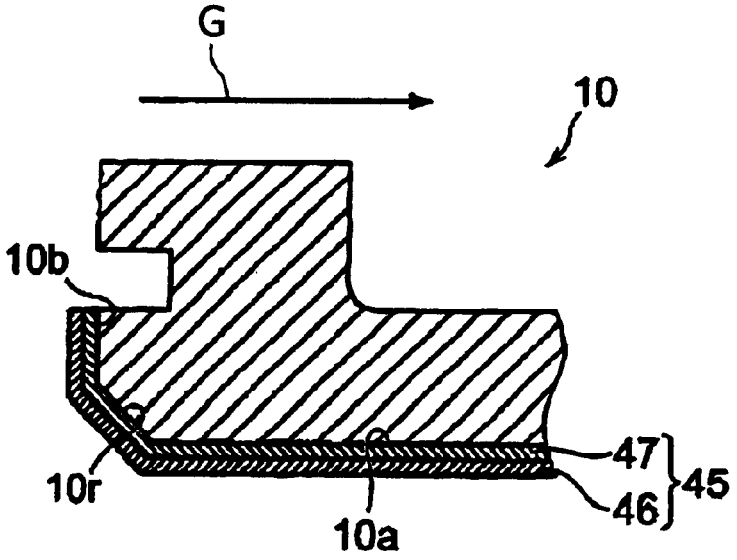
FIG. 9 is an enlarged partial sectional view of an essential portion of a gas turbine split ring in accordance with an embodiment of the present invention.

FIG. 8 is a perspective view showing a split ring provided in the turbine 3 for the above-described gas turbine 1. FIG. 9 is an enlarged partial sectional view showing a split ring provided in the turbine 3. As shown in these figures, a split ring 10 has a gas path surface 10*a* extending in the combustion gas flow direction G. For this split ring 10, a thermal barrier coating 45 (a topcoat 46 and an undercoat 47) covering the gas path surface 10*a* is formed so as to go around from the gas path surface 10*a* to an upstream-side end face 10*b* perpendicular to the combustion gas flow direction G, of the outer peripheral faces, and the upstream-side end face 10*b* is completely coated with the thermal barrier coating 45. In this case, a chamfered portion 10*r* is formed in a peripheral edge portion along the upstream-side end face 10*b*, of the lower-side peripheral edge portions of the split ring 10.

In the turbine split ring 10 constructed as described above, the deterioration and peeling-off of the thermal barrier coating 45 in the upstream-side end portion can be restrained easily and surely. Needless to say, the thermal barrier coating 45 covering the gas path surface 10*a* may be formed so as to go around from the gas path surface to a downstream-side end face and a side end face 10*h* (see FIG. 8), which are perpendicular to the combustion gas flow direction G, of the outer peripheral faces. Further, a step portion may be formed at least in a part of the peripheral edge portion of the split ring 10, by which the thermal barrier coating 45 is formed so as to go around to the step portion, and the end face of the thermal barrier coating 45 is brought into contact with the upper face of the step portion.

What is claimed is:

1. A turbine moving blade comprising a platform having a gas path surface extending in the combustion gas flow direction, and a blade portion erecting on said platform, said gas path surface of platform being coated with a thermal barrier coating, wherein said thermal barrier coating substantially covering said gas path surface and being formed so as to go around from said gas path surface of platform to at least a part of the outer peripheral face of said platform.

2. The turbine moving blade according to claim 1, wherein a step portion is formed in at least a part of the peripheral edge portion of said platform, and said thermal barrier coating is formed so that it goes around to said step portion and the end face thereof is in contact with the upper face of said step portion.

3. A turbine moving blade comprising a platform, a blade portion erecting on said platform, and a shroud provided at the tip end of said blade portion, a gas path surface extending in the combustion gas flow direction of said shroud being coated with a thermal barrier coating, wherein said thermal barrier coating substantially covering said gas path surface and being formed so as to go around from said gas path surface of shroud to at least a part of the outer peripheral face of said shroud.

4. The turbine moving blade according to claim 3, wherein a step portion is formed in at least a part of the peripheral edge portion of said shroud, and said thermal barrier coating is formed so that it goes around to said step portion and the end face thereof is in contact with the upper face of said step portion.

5. A turbine stationary blade comprising a pair of shrouds each having a gas path surface extending in the combustion gas flow direction, and a blade portion held between said shrouds, at least either one of said shrouds being coated with a thermal barrier coating, wherein said thermal barrier coating substantially covering said gas path surface and being formed so as to go around from said gas path surface of shroud to at least a part of the outer peripheral face of said shroud.

6. The turbine stationary blade according to claim 5, wherein a step portion is formed in at least a part of the peripheral edge portion of said shroud, and said thermal barrier coating is formed so that it goes around to said step portion and the end face thereof is in contact with the upper face of said step portion.

7. A turbine split ring having a gas path surface extending in the combustion gas flow direction, said gas path surface being coated with a thermal barrier coating, wherein said thermal barrier coating substantially covering said gas path surface and being formed so as to go around from said gas path surface to at least a part of the outer peripheral face.

8. The turbine split ring according to claim 7, wherein a step portion is formed in at least a part of the peripheral edge portion, and said thermal barrier coating is formed so that it goes around to said step portion and the end face thereof is in contact with the upper face of said step portion.

9. A gas turbine for producing power by expanding a high-temperature and high-pressure combustion gas by using a turbine stationary blade and a turbine moving blade, wherein said turbine moving blade comprises a platform having a gas path surface extending in the combustion gas flow direction, a blade portion erecting on said platform, and a thermal barrier coating far covering said gas path surface of platform, and said thermal barrier coating substantially covering said gas path surface end being formed so as to go around from said gas path surface to at least a part of the outer peripheral face of said platform.

10. A gas turbine for producing power by expanding a high-temperature and high-pressure combustion gas by using a turbine stationary blade and a turbine moving blade, wherein said turbine moving blade comprises a platform, a blade portion erecting on said platform, a shroud provided at the tip end of said blade portion, and a thermal barrier coating for covering a gas path surface extending in the combustion gas flow direction of said shroud, and said thermal barrier coating substantially covering said gas path surface and being formed so as to go around from said gas path surface of shroud to at least a part of the outer peripheral face of said shroud.

11. A gas turbine for producing power by expanding a high-temperature and high-pressure combustion gas by using a turbine stationary blade and a turbine moving blade, wherein said turbine stationary blade comprises a pair of shrouds each having a gas path surface extending in the combustion gas flow direction, a blade portion held between said shrouds, and a thermal barrier coating for covering the gas path surface of at least either one of said shrouds, and said thermal barrier coating substantially covering said gas path surface and being formed so as to go around from said gas path surface of shroud to at least a part of the outer peripheral face of said shroud.

12. A gas turbine for producing power by expanding a high-temperature and high-pressure combustion gas by using a turbine stationary blade and a turbine moving blade, wherein said gas turbine comprises a split ring having a gas path surface extending in the combustion gas flow direction and a thermal barrier coating for covering said gas path surface, which is provided at the outer periphery of said turbine moving blade, and said thermal barrier coating substantially covering said gas path surface and being formed so as to go around from said gas path surface of split ring to at least apart of the outer peripheral face of said split ring.

* * * * *